US005873373A

United States Patent [19]

Narvick

[11] Patent Number: 5,873,373

[45] Date of Patent: Feb. 23, 1999

[54] INTEGRATED WIG HAVING A WEFTING CONSTRUCTION

[75] Inventor: Linda Narvick, Charlestown, Mass.

[73] Assignee: SC Direct, Inc., South Easton, Mass.

[21] Appl. No.: 766,885

[22] Filed: Dec. 13, 1996

[51] Int. Cl.[6] ..... A41G 5/00

[52] U.S. Cl. ..... 132/54

[58] Field of Search ..... 132/201, 53, 54, 132/55, 56

[56] References Cited

U.S. PATENT DOCUMENTS

| | | | |
|---|---|---|---|
| 1,853,976 | 4/1932 | Jacoby et al. | 132/53 |
| 2,789,567 | 4/1957 | Jacoby | 132/53 |
| 3,434,481 | 3/1969 | Mazzocco | 132/53 |
| 3,444,865 | 5/1969 | De Vita | 132/53 |
| 3,470,889 | 10/1969 | Webb | 132/53 |
| 3,485,249 | 12/1969 | Mast | 132/53 |
| 3,777,768 | 12/1973 | Scigliano | 132/53 |
| 3,835,867 | 9/1974 | Molinario | 132/201 |
| 5,406,971 | 4/1995 | Taylor | 132/56 |

FOREIGN PATENT DOCUMENTS

| | | | |
|---|---|---|---|
| 6280104 | 10/1994 | Japan | 132/201 |
| 8300086 | 8/1984 | Netherlands | 132/54 |
| 1388300 | 3/1975 | United Kingdom | 132/53 |

*Primary Examiner*—Todd E. Manahan
*Assistant Examiner*—Eduardo C. Robert
*Attorney, Agent, or Firm*—Wolf, Greenfield & Sacks, P.C.

[57] ABSTRACT

A substantially full wig is provided which is designed to be integrated with the hair of a person wearing the wig. The wig has a wefting construction with spacing between adjacent wefts which is sufficient to form a pattern of openings in the construction, at least most of which openings are of sufficient size to permit a tuft of the wearer's hair which is to be integrated to be pulled through the opening. At least one element is provided on the construction which permits the construction to be fitted to the wearer's head and to be maintained on the wearer's head. Hair fibers, either natural or artificial, of selected color, length and style are attached to the wefts of the construction.

16 Claims, 4 Drawing Sheets

INTEGRATED WIG HAVING A WEFTING CONSTRUCTION

FIELD OF THE INVENTION

This invention relates to wigs, and more particularly to a substantially full wig designed to be integrated with hair from the person wearing the wig.

BACKGROUND OF THE INVENTION

People, particularly women, wear wigs for a variety of reasons, including to cover thinning or balding hair, to permit the wearer to look good when the wearer has not had time to have their hair styled or to style their hair themselves, and to permit the wearer to have a variety of hair styles and lengths without altering their own basic hair length and style. Hairpieces (i.e., partial wigs) are generally not suitable for performing most of these functions and, while full wigs are useful for these and other functions, there are also a number of limitations in wearing existing such wigs.

In particular, the physical properties of existing wigs may oftentimes reduce the wearer's overall sense of comfort. For example, existing wigs tend to add weight and may feel heavy on a wearer's head, and because of their close weave, the air flow, or breathing, of the wearer's scalp may be minimalized or inhibited. This reduction in air flow results in trapped excess heat, and may cause the wearer's scalp to itch. Also, because wigs oftentimes appear noticeably thicker and heavier than natural hair, they may be noticed and identified as a wig, sometimes causing undue embarrassment to the wearer. Lastly, a percentage of wigs are made with human hair instead of synthetic fibers, and because significant human hair is needed to achieve full wig coverage, such wigs can become relatively expensive.

A need therefore exists for an improved wig which is lighter, more comfortable to wear, more natural in appearance, and less expensive. Greater wearer comfort includes a design which facilitates air flow/breathing for the wearer's scalp, thereby substantially eliminating weighty feeling and the heat/itching resulting from the wearing of a wig, and a design which more positively secures the wig to the wearer's head so that the wearer can move her head freely without concern that the wig will move or fall off.

SUMMARY OF THE INVENTION

In accordance with the above, this invention provides a substantially full wig which is designed to be integrated with hair on a wearer's head, the wearer's hair being pulled through openings in the wig and integrated with hair of the wig. The user's hair being integrated with that of the wig helps to secure the wig in place and also provides a far more natural appearance. The wefting construction for the wig has spacing between adjacent wefts, the spacings being sufficient to form a pattern of openings in the construction, at least most of which openings are of sufficient size to permit a significant number of hairs of the wearer which are to be integrated to be pulled through the openings. At least one element is provided on the periphery of the construction which permits the construction to be fitted to the wearer's head and to be maintained on the wearer's head. Hair, either natural (human) or artificial (fiber) of a selected color and length and curl pattern is attached to wefts of the construction.

The elements on the periphery of the construction may include elastic attached to at least the rear portion of the periphery of the construction, and for some embodiments the elastic may extend for at least most of the periphery of the construction. This element may alternatively be an adjustment member at the rear of the periphery which adjustment member may be a hook, button or snap attachment or may be formed of a synthetic material which adheres when pressed together, for example, VELCRO™.

The openings in the construction may be of substantially uniform size over the entire construction, or the openings in the construction may be larger in a first area of the construction and smaller in second area of the construction. The first area of the construction with larger openings may cover the top of the wearer's head and the second area with smaller openings cover the back and sides of the wearer's head or vice versa, depending on coverage. For some embodiments, the openings in the construction are substantially elongated, the sides of such openings preferably of a length of approximately 0.5 inches to 2.5 inches The area of the openings, whether rectangular or otherwise, are preferably in a range of approximately 0.5 square inches to 4.5 square inches.

Additional wefting or other fabric such as elastic, lace, etc. may be provided across at least selected openings to modify the size/shape thereof. Such additional material may for example extend diagonally across the openings. Where the openings have long and short sides, double wefting may form some sides of the openings to enhance the strength thereof and at least double wefting may be provided at the periphery of the construction for added strength.

The foregoing and other objects, features and advantages of the invention will be apparent from the following more particular description of preferred embodiments of the invention as illustrated in the accompanying drawings.

IN THE DRAWINGS

DETAILED DESCRIPTION

Figure 1:
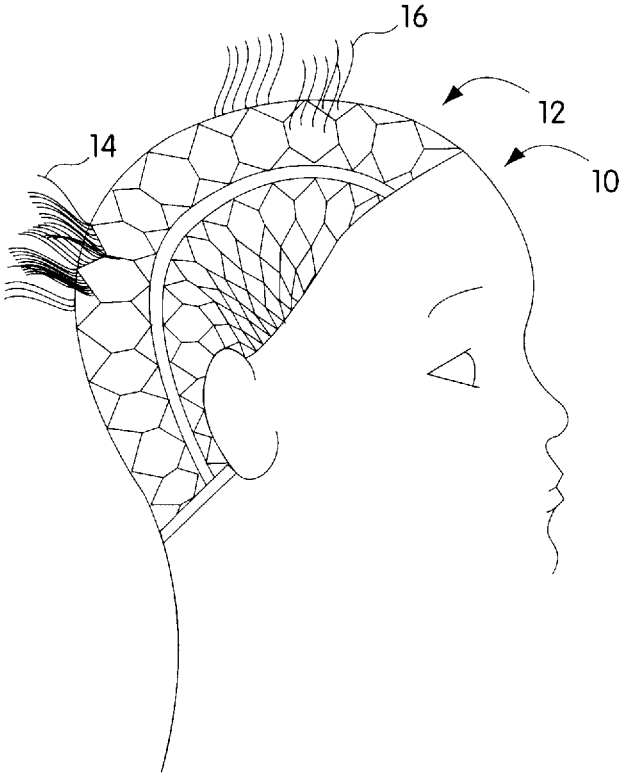
FIG. 1 is a side view of a person wearing a wig in accordance with the teachings of this invention, with hairs of the wearer being integrated with hairs of the wig.

In FIG. 1, the head of a person 10 is shown wearing a wig 12 in accordance with the teachings of this invention, which wig has natural or artificial hairfibers 14 which are attached to the wig. Hairs 16 of wearer 10 are also integrated in a manner to be described later through openings in wig 12 with the fibers 14 of the wig. Since the hairs 16 of the wearer pass through and are integrated with the artificial or natural hair fibers of the wig, the user's hair helps to anchor the wig in place and provides a more natural overall appearance, making it less obvious that a wig is being worn. Other features securing the wig in place are discussed later.

Figure 2:
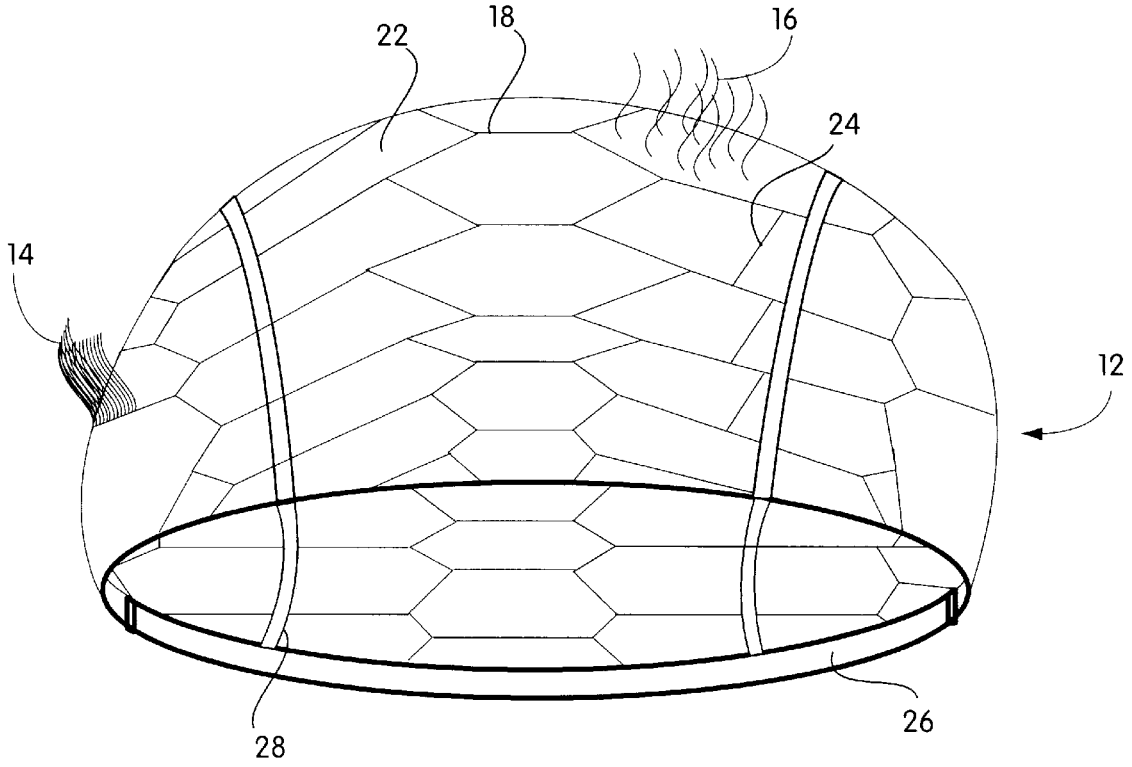
FIG. 2 is an enlarged top view of a wig wefting construction in accordance with the teachings of this invention, with some illustrative hairs being shown attached to the wefting construction.

Referring to FIG. 2, it is seen that the wig 12 consists of a wefting construction formed of spaced wefts 18, with adjacent wefts being selectively secured together so as to provide a pattern of elongated six-sided openings 22 in wig 12, each of which openings 22 has double wefting along its long edges and is large enough to permit a significant tuft of the wearer's hairs 16 to be easily integrated therethrough. While the precise dimensions for the openings 22 are not critical, with elongated openings as shown in FIG. 2, a spacing between adjacent wefts which defines the short dimension of the opening should generally not be less than 0.5 inch in order to permit easy integration of significant hair through the opening, and typically are not less than 0.7 inches. Similarly, in order to maintain adequate strength for the construction, and sufficient hair on the wig to provide an aesthetically pleasing appearance, the openings should not have long dimensions which are greater than approximately 2½ inches and a maximum of approximately 1.5 to 2 inches is preferred. Regardless of the shape of the openings 22, the total area should normally be not less than 0.5 square inches nor greater than 4.5 square inches for preferred embodiments. However, all that is required to comply with the teachings of the invention is that the holes not be so small as to prevent easy integration of significant hair therethrough, which is the case for current wigs which may have openings with an area in a range of 0.01 square inches or less. For some styles, double wefts may be provided for most or all wefts in the construction to enhance strength. The double wefts may be sewn together and/or may be twisted to enhance strength before being sewn. Additional wefts, for example, diagonal wefts, elastic or other fabric 24 may be provided across some of the openings 22, particularly larger ones of such openings, to provide added strength and/or to provide added wefting to which hairs may be attached. For a given wig construction, all of the openings 22 may be of uniform size or some of the openings 22 may be larger than others. For example, as shown in FIG. 2, openings at the top or crown of the head may be larger to permit greater integration in these areas and a lighter volume of wig fiber 14, while the back and sides of the wig may have smaller openings 22 to provide greater strength in these areas and to provide greater volume of wig fiber 14. Wig fibers 14 may be, as indicated earlier, artificial or synthetic fibers or may be natural hair and may be machine sewn, hand sewn or otherwise attached to wefting 18 and 24 in standard fashion. To permit better viewing of the wefting construction, only some of fibers 14 are shown in FIG. 2; however, in a finished wig, most, if not all, of the wefts 18, 24 would have fibers attached thereto.

For the embodiment shown in FIG. 2, the periphery of the wig is shown as having a wide elastic 26 in the rear and side portions thereof. Single, double or other wefting or other fabric, or a narrower or lighter elastic may extend over the forward portion of the periphery. For one embodiment, ⅜ inch elastic extends from the nap of wearer's neck to approximately the user's ears for a comfortable fit, with ¼ inch elastic 28 extending across the temple area for comfort and contour. Double or triple wefting may also be utilized at the periphery to which the elastics are sewn or otherwise secured to provide strength at the periphery of the wig. Elastics 26 and/or 28 permit the wig 12 to be easily fitted over the head of wearer 10. They also hold the wig in place when on the wearer's head. Since the wig 12 is designed to be integrated with the hair of the user, it contains only a fraction of the wefting and a fraction of the hair required for a normal wig and is therefore significantly lighter and therefore easier to hold in place.

Figure 3A:
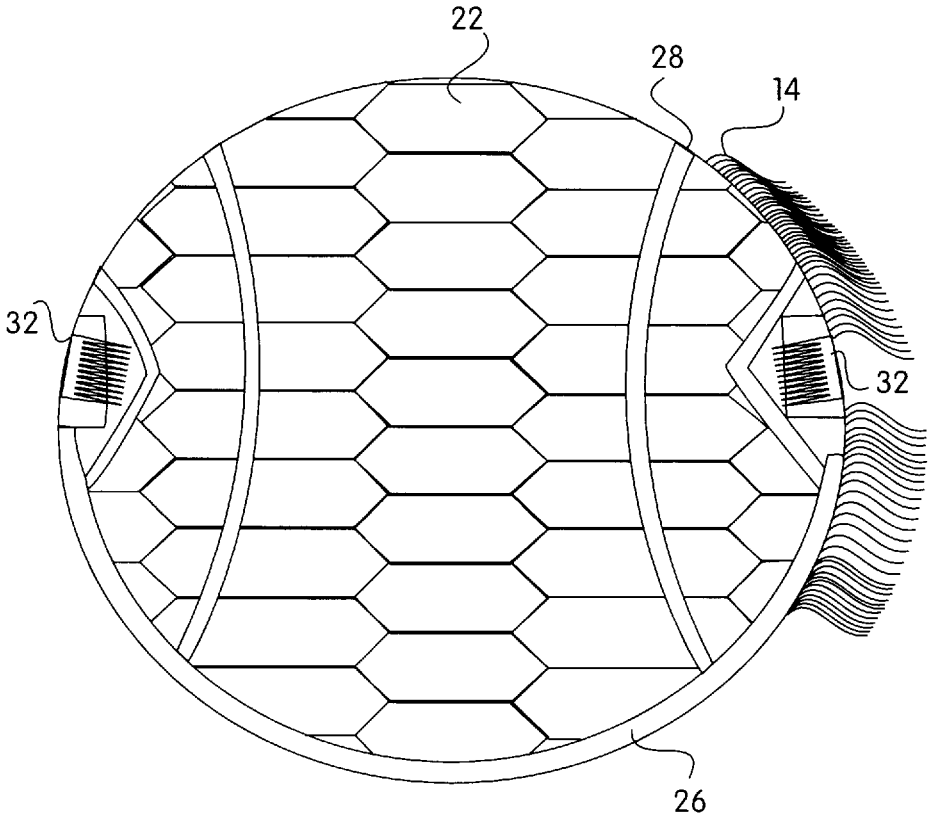
FIG. 3A is a full top view.
Figure 3C:
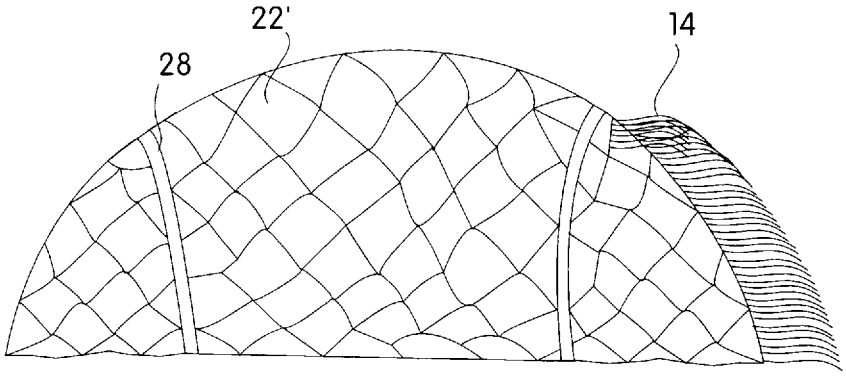
FIGS. 3B, 3C are partial top views of wefting constructions illustrating alternative embodiments of the invention.
Figure 3B:
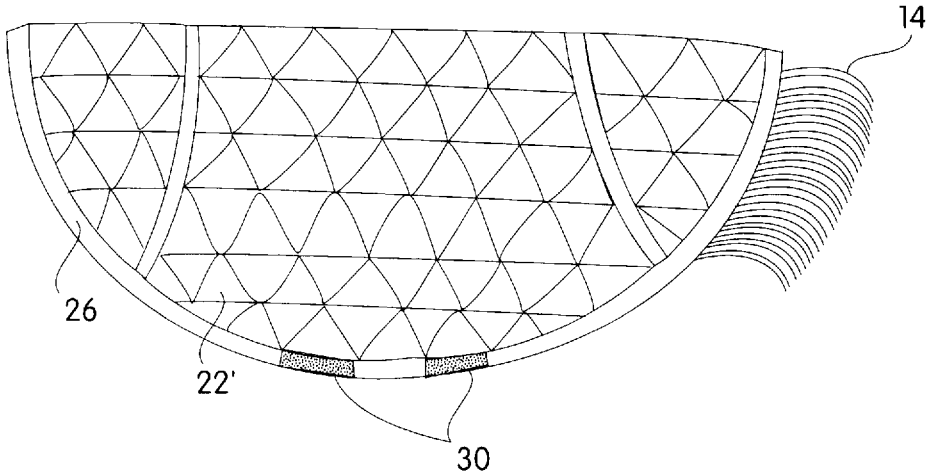

FIGS. 3A, 3B and 3C illustrate various alternative embodiments of the invention. For FIG. 3A, rather than relying only on an elastic 26 to permit the wig to be held on the wearer's head, a pair of combs 32 are provided at the periphery of the wig, for example behind the wearer's ears, to further secure the wig in place. For most full wigs, combs 32 should not be required; however, they may be required in situations where the wig is slightly less than full.

FIG. 3B illustrates an attachment element 30 which is shown at the rear of the wig's periphery in FIG. 3B, but may also be on the side periphery of the wig, which may be utilized either in addition to or instead of the elastic to hold the wig in place. Attachment elements 30 are preferably formed of synthetic material which adhere's when pressed together, for example VELCRO™; however, attachment elements 30 may also be hooks, snaps, buttons, clips or other attachment elements commonly used for this purpose.

The second difference illustrated in FIG. 3B is that the wefting pattern is such that openings 22' are triangular in shape rather than elongated rectangular. FIG. 3C illustrates a diamond wefting pattern. Again, double wefting could be provided for selected sides of openings 22' for enhanced strength and the openings 22' could be of uniform size or of varying size as required. Further, while several shapes of openings have been shown in the figures, and at least because of ease of fabrication, opening in these shapes are preferred, this is not a limitation on the invention, and openings having other shapes could be utilized.

An improved wig construction is thus provided which is significantly lighter than existing wigs, provides a far more natural appearance, uses far less materials and is therefore less expensive to fabricate, and which has an open construction which permits greater air circulation/breathing for the wearer's scalp, thereby being cooler and more comfortable to wear. The wig is also easier to secure to the wearer's head and provides a far more natural overall appearance, even when the user's hair has not been styled.

While the invention has been shown and described above with reference to preferred embodiments, the foregoing and other changes of form and detail may be made therein by one skilled in the art without the departing from the spirit and scope of the invention.

What is claimed is:

1. A wig designed to be integrated with hair on a wearer's head comprising:

a construction which is at least primarily formed of adjacent wefts having spacings therebetween, the spacings being sufficient to form a pattern of openings over substantially the entire construction, at least most of which openings are of sufficient size to permit tufts of the wearer's hair which is to be integrated to be pulled therethrough;

said construction having a periphery, with at least one element on said periphery which permits the construction to be fitted to the wearer's head and to be maintained on the wearer's head; and fibers of selected color, length and style attached to the wefts of said construction.

2. A wig as claimed in claim 1 wherein said at least one element includes elastic attached to at least a rear portion of said periphery.

3. A wig as claimed in claim 2 wherein said at least one element includes elastic attached to at least most of said periphery.

4. A wig as claimed in claim 1 wherein said at least one element includes an attachment member at a rear portion of said periphery.

5. A wig as claimed in claim 4 wherein said attachment member is formed of synthetic materials which adhere when pressed together.

6. A wig as claimed in claim 4 wherein said attachment member is one of a hook, button, clip and snap attachment.

7. A wig as claimed in claim 1 wherein said openings in the construction are of substantially uniform size over said construction.

8. A wig as claimed in claim 1 wherein said openings in the construction are larger in first areas of the construction and smaller in second areas of the construction.

9. A wig as claimed in claim 8 wherein said first areas of the construction are areas at a top of the construction and wherein said second areas are areas at a back and sides of the construction.

10. A wig as claimed in claim 1 wherein said openings in the construction are substantially elongated.

11. A wig as claimed in claim 1 wherein said openings have dimensions along the wefts and perpendicular thereto in a range of approximately 0.5 inches to 2.5 inches.

12. A wig as claimed in claim 1 wherein each said opening has an area in a range of approximately 0.5 square inches to 4.5 square inches.

13. A wig as claimed in claim 1 wherein additional material is provided across at least selected ones of said openings to reduce the size thereof.

14. A wig as claimed in claim 13 wherein said additional material extends diagonally across said opening.

15. A wig as claimed in claim 1 wherein said openings have long and short sides, and including double wefting along the long sides of the said openings.

16. A wig as claimed in claim 1 including at least double wefts at said periphery.

* * * * *